US010415867B2

(12) United States Patent
Yang

(10) Patent No.: US 10,415,867 B2
(45) Date of Patent: Sep. 17, 2019

(54) REFRIGERATOR PROVIDED WITH ICE MAKER AND WATER SUPPLY UNIT

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 62 days.

(21) Appl. No.: 15/607,220

(22) Filed: May 26, 2017

(65) Prior Publication Data

US 2018/0017308 A1 Jan. 18, 2018

(30) Foreign Application Priority Data

Jul. 12, 2016 (KR) ..... 10-2016-0088271

(51) Int. Cl.

| | |
|---|---|
| ***F25C 1/24*** | (2018.01) |
| ***F25D 23/12*** | (2006.01) |
| ***F25C 5/08*** | (2006.01) |
| ***F25C 1/25*** | (2018.01) |
| *F25C 1/04* | (2018.01) |
| *F25D 11/02* | (2006.01) |
| *F25D 23/08* | (2006.01) |

(52) U.S. Cl.

CPC ..... *F25C 1/24* (2013.01); *F25C 1/25* (2018.01); *F25C 5/08* (2013.01); *F25D 23/12* (2013.01); *F25C 1/04* (2013.01); *F25C 2400/10* (2013.01); *F25C 2400/14* (2013.01); *F25D 11/02* (2013.01); *F25D 23/08* (2013.01); *F25D 2323/121* (2013.01)

(58) Field of Classification Search

CPC ..... F25C 1/24; F25C 1/25; F25C 2400/14

See application file for complete search history.

(56) References Cited

U.S. PATENT DOCUMENTS 4,889,316 A * 12/1989 Donahue, Jr. ..... F16K 31/06 251/129.15
5,953,929 A * 9/1999 Bauman ..... F25D 19/00 62/237
8,413,459 B2 4/2013 Kim et al.
(Continued)

FOREIGN PATENT DOCUMENTS

GB 2275328 A 8/1994
GB 2282216 A 3/1995
(Continued)

*Primary Examiner* — Jonathan Bradford

(57) ABSTRACT

A refrigerator includes an ice maker installed in a refrigeration compartment or a freezer. A machine compartment is located in a lower rear portion of the refrigerator and includes a valve configured to distribute water for supply to the ice maker. A water supply unit is configured to supply water from the valve to the ice maker. The water supply unit includes an ice maker tube extending to the ice maker to supply water, and a guide cap to which one end portion of the ice maker tube is fitted. The guide cap includes sealing projections inserted into the ice maker tube and spaced apart from each other along a longitudinal direction of the ice maker tube. The sealing projections are configured to make close contact with the ice maker tube to prevent water leakage from the ice maker tube.

5 Claims, 6 Drawing Sheets

(56) References Cited

U.S. PATENT DOCUMENTS

| | | | | |
|---|---|---|---|---|
| 2015/0159934 | A1* | 6/2015 | Choi | F25D 23/126 62/344 |
| 2016/0054048 | A1 | 2/2016 | Faehnle et al. | |
| 2016/0085245 | A1* | 3/2016 | Faehnle | F25D 23/126 137/613 |

FOREIGN PATENT DOCUMENTS

| | | | |
|---|---|---|---|
| JP | H10-103827 | A | 4/1998 |
| KR | 10-0376164 | B1 | 3/2003 |
| KR | 10-2012-0063615 | A | 6/2012 |
| KR | 10-1548263 | B1 | 8/2015 |
| WO | 2013007687 | A2 | 1/2013 |

* cited by examiner

REFRIGERATOR PROVIDED WITH ICE MAKER AND WATER SUPPLY UNIT

CROSS-REFERENCE TO RELATED APPLICATION

This application is based on and claims priority from Korean Patent Application No. 10-2016-0088271, filed on Jul. 12, 2016, the disclosure of which is incorporated herein in its entirety by reference for all purposes.

TECHNICAL FIELD

Embodiments of the present disclosure relate to refrigerators, and more particularly, to ice making and dispensing mechanisms in refrigerators.

BACKGROUND OF THE INVENTION

A refrigerator is an appliance used for storing food or other items at low temperature, e.g., in a frozen or refrigerated state.

The interior of a refrigerator is cooled by circulation of cold air which can be continuously generated as a refrigerant recycles through compression, condensation, expansion and evaporation cycles. Cold air supplied in the refrigerator is uniformly distributed by convection.

A refrigerator typically includes a main body having a rectangular parallelepiped shape with a front opening. A refrigeration compartment and a freezer may be disposed in the main body, each covered by a door. Drawers, racks, storage boxes and the like for sorting and storing different kinds of items may be disposed in the internal storage space of the refrigerator.

In general, a top-mount-type refrigerator has a freezer located on top of a refrigeration compartment. In contrast, a bottom-freezer-type refrigerator has a freezer located under the refrigeration compartment. This enables a user to conveniently access the refrigeration compartment. However, on the other hand, this may be inconvenient for a user to access the freezer, if the user has to bend or lower to reach, e.g., to take out ice pieces.

Some bottom-freezer-type refrigerators have an ice dispenser disposed in a refrigeration compartment door located at the upper side of the refrigerator. In this case, an ice-making device for supplying ice may be disposed in the refrigeration compartment door or the interior of the refrigeration compartment.

In a refrigerator with an ice maker, a water supply connector is typically disposed in an upper portion of a rear wall of the refrigerator to supply water to the ice maker. However, the water supply connector is usually ineffective in providing a water seal. For example, if ice forms in an internal water supply route coupled to the ice maker, water may flow backward to the water supply connector and may leak out to the outside along the rear wall of the refrigerator. Water leakage may infiltrate into a power supply unit of the refrigerator, causing a short circuit and even a fire accident.

Furthermore, due to water backflow to the water supply connector, the amount of water supplied to the ice maker may fluctuate. This may cause the size of the produced ice to be non-uniform.

Moreover, conventionally, the water supply connector is made of soft components which need to be deformed to fit in a water supply hose. Sometimes, excessive insertion of the water supply hose may cause poor water supply.

PRIOR ART DOCUMENTS

Patent Documents

Patent Document 1: Korean Patent No. 10-1561349 (published on Oct. 16, 2015)

SUMMARY OF THE INVENTION

Embodiments of the present disclosure provide a refrigerator having a water supply unit which can supply water to an ice maker with reduced water leakage and improved consistency in the water supply rate.

According to an embodiment of the present disclosure, the sealing performance of the water supply unit for supplying water to the ice maker is enhanced to prevent water backflow, and thereby reduce water leakage. As a result, the water supply rate to the ice maker and the ice size can be maintained consistent.

According to an embodiment of the present invention, a refrigerator includes: a refrigerator main body; a refrigeration compartment formed in the main body; a freezing compartment formed in the main body; a machine compartment formed in a lower rear portion of the main body and having a valve configured to distribute water; and a water supply unit configured to supply water fed from the valve to an ice maker disposed in the refrigeration compartment or the freezing compartment. The water supply unit includes: a housing; an ice maker tube inserted into the housing and configured to extend to the ice maker to supply water; and a guide cap fitting on one end portion of the ice maker tube, the guide cap including sealing projections inserted into the ice maker tube and spaced apart from each other along a longitudinal direction of the ice maker tube, the sealing projections being configured to make close contact with the ice maker tube to prevent water leakage from the ice maker tube.

Further, a sealing washer is disposed at an inner side of the guide cap to make close contact with the guide cap. The sealing washer is configured to prevent ambient air from entering the ice maker tube. The sealing washer is installed on an outer circumferential surface of one end portion of the ice maker tube.

Further, an enlarged tube portion is formed in one end portion of the ice maker tube and configured to prevent the sealing washer and the ice maker tube from being separated from each other.

Further, a heater unit is installed on an outer circumferential surface of the ice maker tube to prevent ice formation thereon. The heater unit extends along a longitudinal direction of the ice maker tube.

Further, an insulation member is installed between the heater unit and the housing.

The water supply unit further includes: a first supply pipe configured to receive water from the valve; a second supply pipe extending in a direction intersecting the first supply pipe and inserted into the guide cap to supply water to the ice maker tube; and a pipe connector configured to interconnect the first supply pipe and the second supply pipe extending in different directions and configured to change the water flow direction. The pipe connector is fitted to the guide cap.

The water supply unit further includes: a cover part coupled to the housing to prevent the guide cap and the pipe connector from being exposed to the outside; and an elastic member disposed between the cover part and the pipe connector and configured to press the pipe connector.

In another embodiment, a water supply unit includes a housing; an ice maker tube inserted into the housing and configured to supply water to an ice maker; and a guide cap coupled to one end portion of the ice maker tube and including sealing projections that are inserted into the ice maker tube and spaced apart from each other along a longitudinal direction of the ice maker tube. The sealing projections are configured to make close contact with the ice maker tube to prevent water leakage from the ice maker tube.

Further, a sealing washer is disposed at an inner side of the guide cap to make close contact with the guide cap. The sealing washer is configured to prevent ambient air from entering the ice maker tube and is installed on an outer circumferential surface of one end portion of the ice maker tube.

Further, an enlarged tube portion is formed in one end portion of the ice maker tube and configured to prevent the sealing washer and the ice maker tube from being separated from each other.

The water supply unit further includes a first supply pipe configured to receive water from a valve; a second supply pipe extending in a direction intersecting the first supply pipe and inserted into the guide cap to supply water to the ice maker tube; and a pipe connector configured to interconnect the first supply pipe and the second supply pipe and configured to redirect water flow. The pipe connector is fitted to the guide cap.

The water supply unit further includes: a cover part coupled to the housing to prevent the guide cap and the pipe connector from being exposed to the outside; and an elastic member disposed between the cover part and the pipe connector and configured to press the pipe connector.

DETAILED DESCRIPTION

Figure 1A:
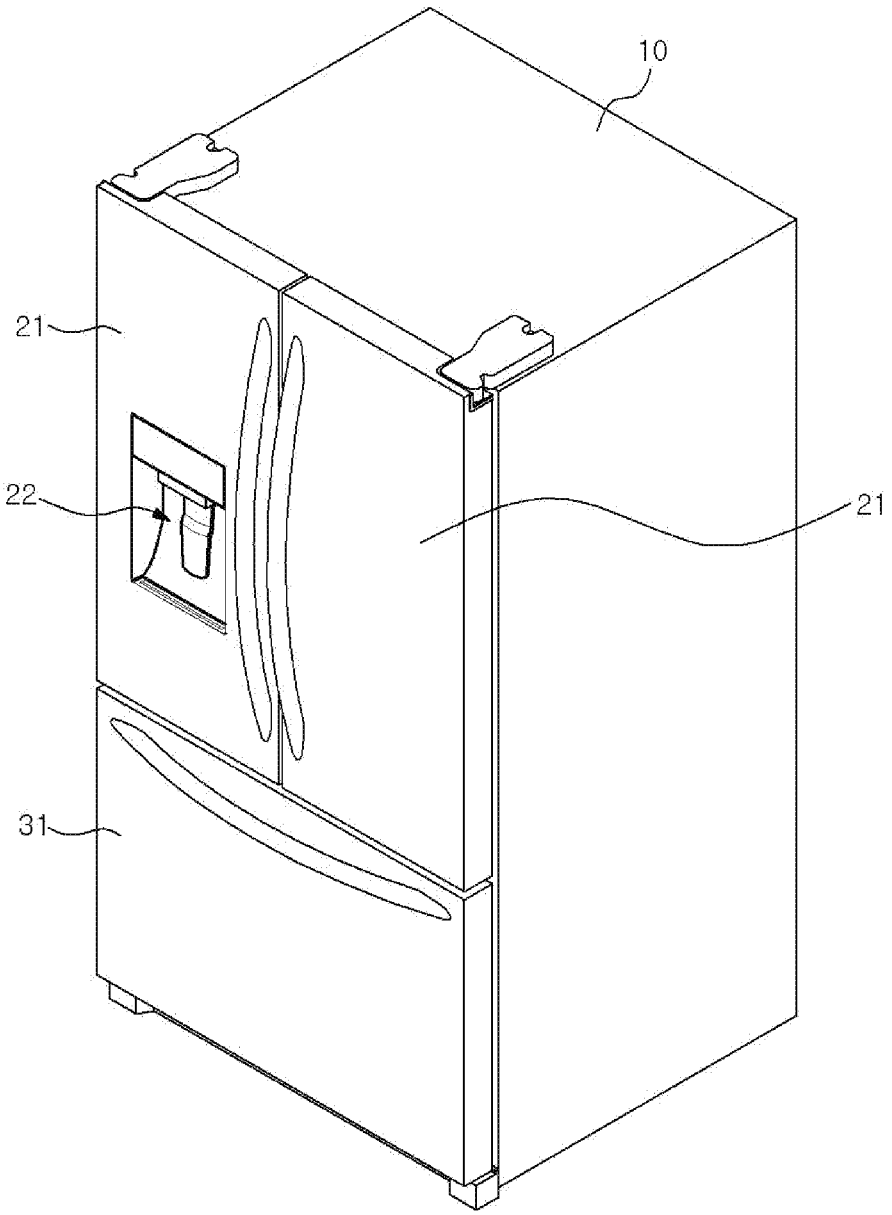
FIG. 1A is a perspective view illustrating the configuration of an exemplary refrigerator including an ice maker according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to any specific form, and for example, may include modifications due to manufacturing.

Figure 1B:
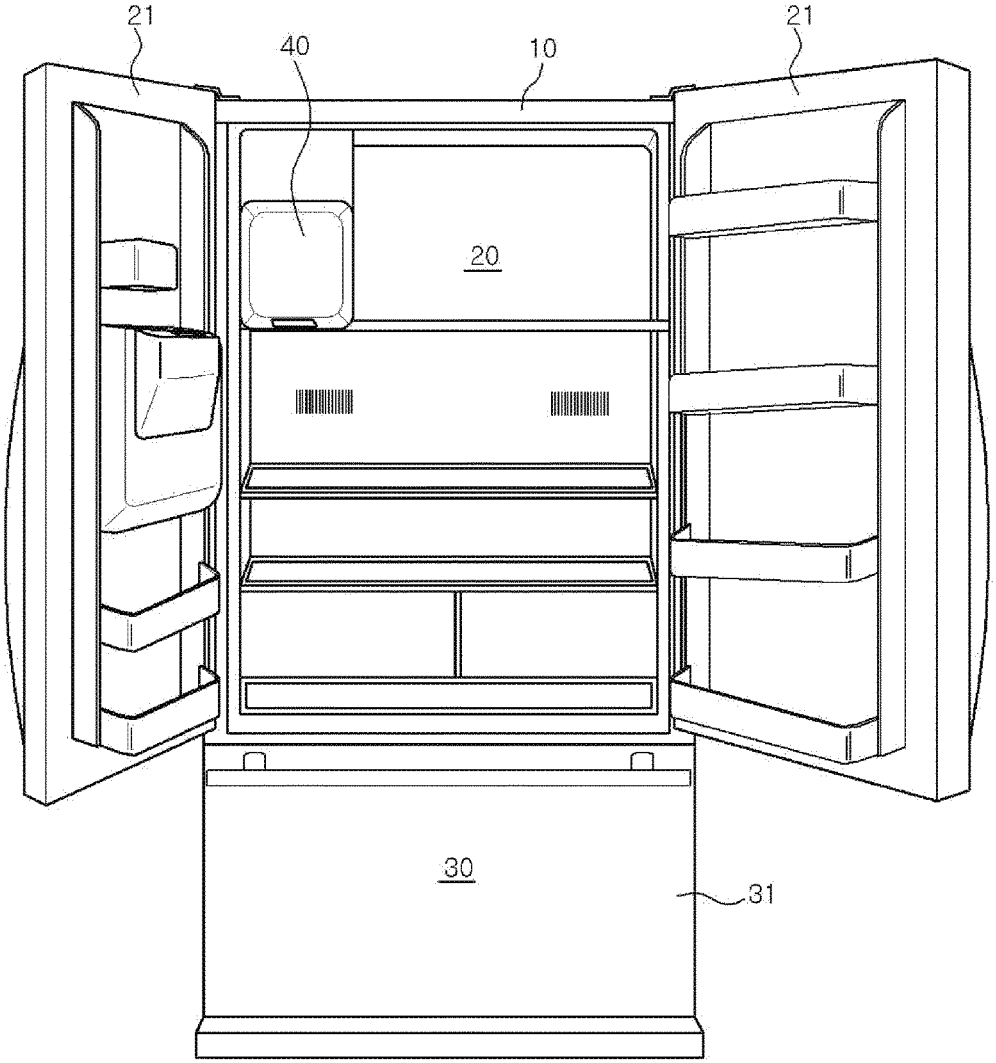
FIG. 1B is a front view of the exemplary refrigerator according to one embodiment of the present disclosure.
Figure 2:
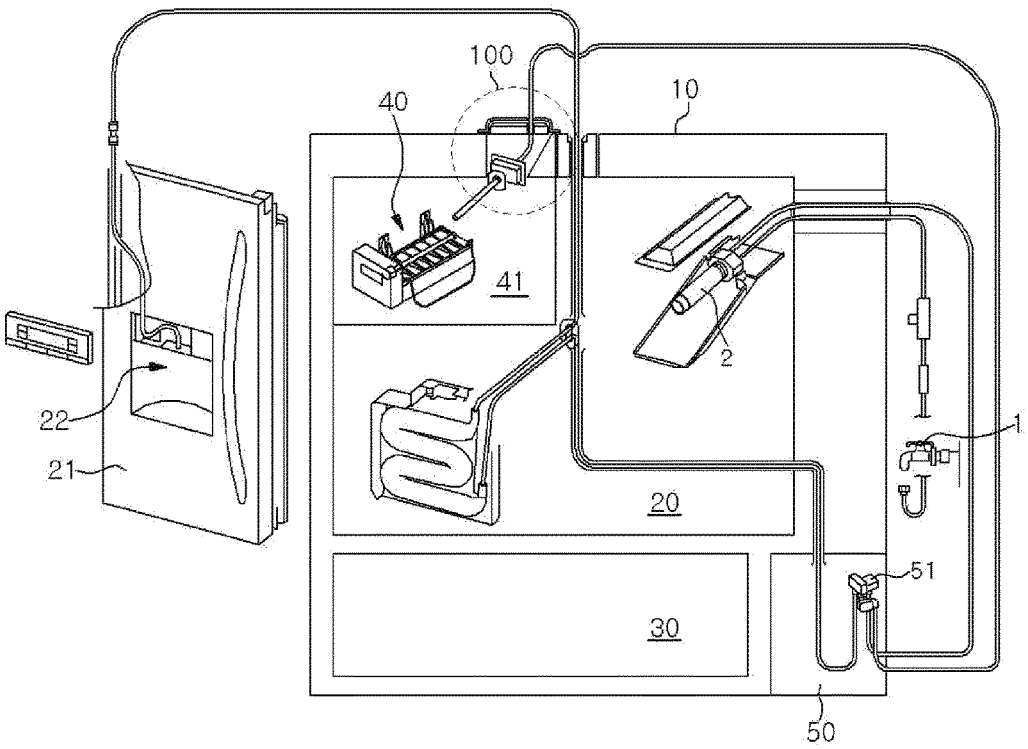
FIG. 2 illustrates an exemplary water supply line of the refrigerator according to one embodiment of the present disclosure.

FIG. 1A is a perspective view illustrating the configuration of an exemplary refrigerator including an ice maker according to one embodiment of the present disclosure. FIG. 1B is a front view of the exemplary refrigerator according to one embodiment of the present disclosure. FIG. 2 illustrates an exemplary water supply line of the refrigerator according to one embodiment of the present disclosure.

A bottom-freezer-type refrigerator is illustrated and described by way of example only. However, the present disclosure is not limited thereto. It will be appreciated that the present disclosure can be applied to various types of refrigerators that are well known in the art.

As illustrated in FIGS. 1A and 1B, the exemplary refrigerator includes a main body 10 having a rectangular parallelepiped shape with a front opening. A storage space for storing food and other types of items is formed within the main body 10.

The storage space of the main body 10 may be partitioned into multiple compartments, including a refrigeration compartment 20 and a freezer 30. The flow rate of cold air supplied into each compartment can be independently controlled such that the refrigeration compartment 20 and the freezer 30 can be maintained at different temperatures suitable for refrigerating and freezing respectively.

The front opening of the main body 10 may be sealed by doors for the refrigeration compartment 20 and the freezer 30. For example, the refrigeration compartment 20 may be formed in a portion (e.g., an upper portion) of the main body 10. A rotatable door 21 configured to cover refrigeration compartment 20 may be mounted to the main body 10. The freezer 30 may be formed in another portion (e.g., a lower portion) of the main body 10. A freezer has a sliding drawer 31 mounted to the main body 10. The drawer 31 can be pulled out from or inserted into the freezer 30 by a user.

A dispenser 22 may be disposed at one side of the refrigeration compartment door (e.g., the rotatable door 21). The dispenser 22 enables a user to dispense purified water and ice cubes or "pieces" produced inside the main body 10. The dispenser 22 is located in a recess on the door 21.

Referring to FIG. 2, an ice maker 40 for producing ice pieces may be disposed in the refrigeration compartment 20 or the freezer 30. For example, if the ice maker 40 is located in the refrigeration compartment 20, the ice maker 40 is disposed within an ice-making compartment 41 isolated from the refrigeration compartment 20. The ice-making compartment 41 may receive cold air from a cooling unit and may be maintained at a different temperature from the refrigeration compartment 20. The position of the ice maker 40 illustrated in FIG. 2 is merely exemplary and the present disclosure is not limited thereto. It is appreciated that the ice maker 40 may be disposed in any other position on the refrigeration compartment 20, the freezer 30 or the rotatable door 21 of the refrigeration compartment 20.

As illustrated in FIG. 2, in the case of a bottom-freezer-type refrigerator in which the refrigeration compartment 20 is located at the upper portion of the main body 10 and the freezer 30 is located at the lower portion of the main body 10, a machine compartment 50 may be formed at the rear side of the lower portion of the main body 10. The machine compartment 50 accommodates various devices including a device used for driving a water supply. The machine compartment 50 may be located at the rear side of the refrigeration compartment 20. In this regard, a valve 51 may be installed in the machine compartment 50. The valve 51 may receive water supplied from a tap 1 and passed through a filter 2 and controls water distribution to the ice maker 40.

The ice maker 40 may be disposed inside the refrigeration compartment 20 or inside the rotatable door 21. A water supply unit 100 can supply water from the valve 51 to the ice maker 40.

Hereinafter, the water supply unit 100 is described in detail with reference to FIGS. 3 to 5.

Figure 3:
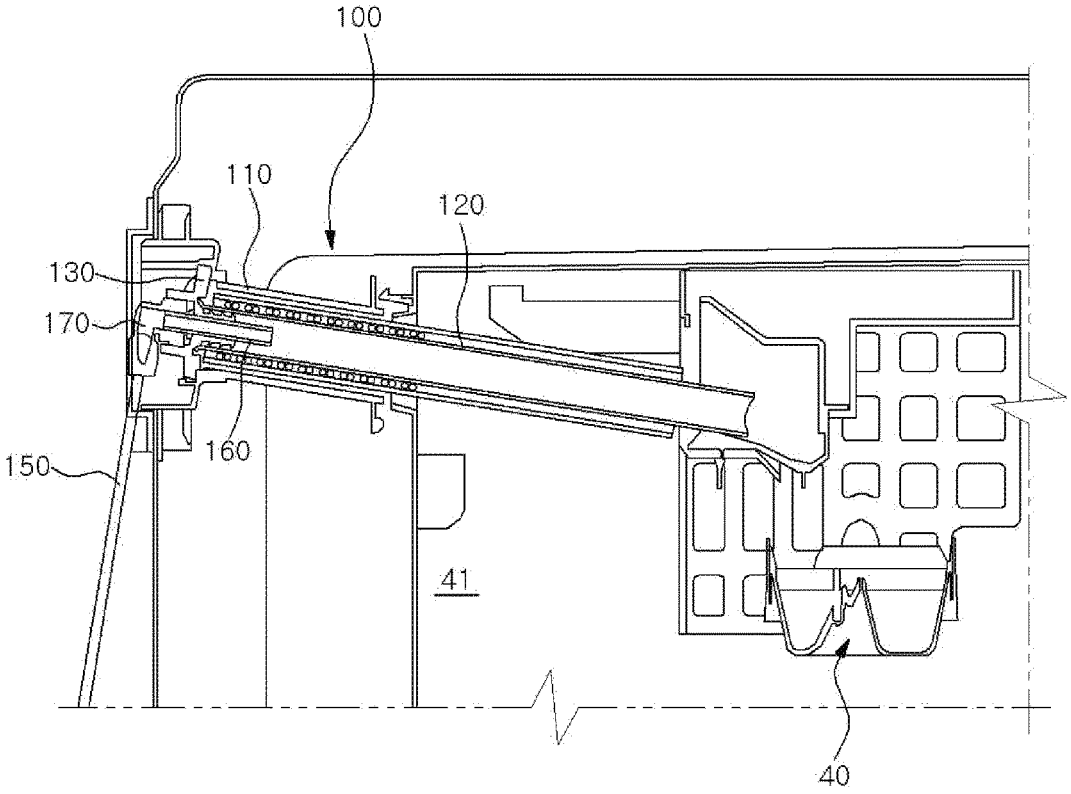
FIG. 3 illustrates the configuration of an exemplary water supply unit according to one embodiment of the present disclosure.

FIG. 3 illustrates the exemplary water supply unit according to one embodiment of the present disclosure. FIG. 4 is a sectional view illustrating the structure of the exemplary water supply unit according to one embodiment of the present disclosure. FIG. 5 is a perspective view illustrating a cover part installed in the exemplary water supply unit according to one embodiment of the present disclosure.

Figure 4:
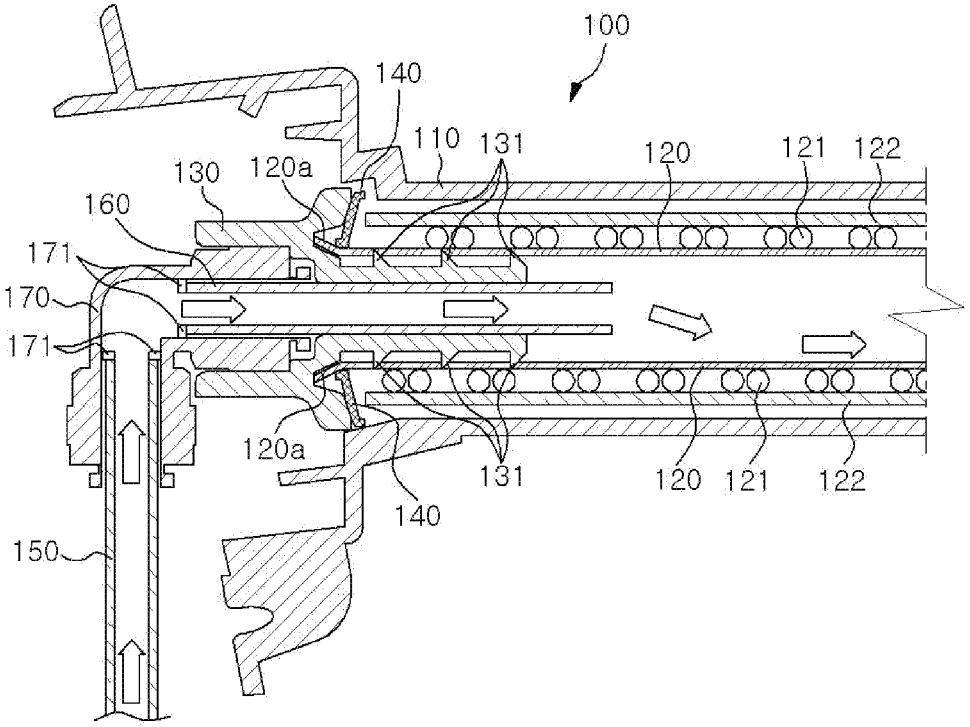
FIG. 4 is a cross sectional view illustrating the configuration of the exemplary water supply unit according to one embodiment of the present disclosure.

As illustrated in FIGS. 3 and 4, the water supply unit 100 may include a housing 110, an ice maker tube 120 and a guide cap 130.

The housing 110 may define an outer shell of the water supply unit 100. Other components may be installed within the housing 110 or on a surface of the housing 110.

As illustrated in FIGS. 3 and 4, the ice maker tube 120 is inserted into the housing 110. The ice maker tube 120 is a long pipe passing through a rear wall of the ice-making compartment 41 and extending to the ice maker 40 that is disposed within the ice-making compartment 41. The ice maker tube 120 is configured to supply water to the ice maker 40. The ice maker tube 120 may be made of metal. Thus, if water flowing through the ice maker tube 120 is frozen by the cold air in the ice-making compartment 41, the ice maker tube 120 may be clogged. To prevent this, a heater unit 121 may be installed on the outer circumferential surface of the ice maker tube 120 and extend in the longitudinal direction. The heater unit 121 may extend to a boundary portion of an ice-making compartment wall so that the heater unit is substantially or completely positioned outside the ice-making compartment 41.

A heating wire may be used as the heater unit 121. The heater unit 121 may be spirally wound around the outer surface of the ice maker tube 120. An insulation member 122 for electrical insulation may be installed between the heater unit 121 and the housing 110. The insulation member 122 may cover the heater unit 121 (e.g., a heating wire), thereby preventing electric shock or short circuit.

The guide cap 130 may be fitted to one end portion of the ice maker tube 120 and may include sealing projections 131 to enhance contact between the ice maker tube 120 and a portion of the guide cap 130 inserted into the bore of the ice maker tube 120. The guide cap 130 and the sealing projections 131 may be made of a soft synthetic resin (e.g., silicon) which provides sealing effect and adhesive effect. The sealing projections 131 are distributed along an elongated direction of the ice maker tube 120.

There may be multiple sealing projections 131 that are spaced apart along the longitudinal direction within the ice maker tube 120. The sealing projections 131 may tightly contact the inner circumferential surface of the ice maker tube 120, which can prevent water leakage as water is supplied into the ice maker tube 120.

The sealing projections 131 may protrude from the guide cap 130 positioned inside the ice maker tube 120 toward the inner circumferential surface of the ice maker tube 120. The sealing projections 131 may have sharp ends and may be made of an elastic material. Thus, the sealing projections 131 may be pressed against, and brought into close contact with, the inner circumferential surface of the ice maker tube 120. The sealing projections 131 having such a structure may be spaced apart from each other along the longitudinal direction within the ice maker tube 120. In this configuration, the sealing projections 131 can stop an outward flow of the water, thereby enhancing water sealing.

In this regard, a sealing washer 140 configured to make tight contact with the guide cap 130 may be installed on the outer circumferential surface of one end portion of the ice maker tube 120. The sealing washer 140 may prevent ambient air from entering the ice maker tube 120 and thus maintain the temperature inside the ice maker tube.

Furthermore, an enlarged tube portion 120*a* having an increased diameter may be formed in one end portion of the ice maker tube 120 and can prevent separation of the sealing washer 140 and the ice maker tube 120. Thus, the sealing washer 140 engages with the enlarged tube portion 120*a* of the ice maker tube 120. As a result, the sealing washer 140 would not be moved or displaced beyond the end portion of the ice maker tube 120. Likewise, the ice maker tube 120 may be maintained at a fixed location because of the enlarged tube portion 120*a* that engages with the sealing washer 140.

The water supply unit 100 may further include a first supply pipe 150, a second supply pipe 160 and a pipe connector 170. The pipe connector 170 advantageously can allow consistent water supply even when the water supply line is bent and can prevent movement of the water supply line.

The first supply pipe 150 may be configured to supply water from the valve 51 installed in the machine compartment 50 of the refrigerator.

The second supply pipe 160 may be disposed to extend in a direction intersecting the first supply pipe 150. As illustrated in FIG. 4, the second supply pipe 160 may be inserted into the guide cap 130 and may supply water to the ice maker tube 120. In this case, the second supply pipe 160 may be installed inside the guide cap 130 and closely contact the inner circumferential surface of the portion of the guide cap 130 where the sealing projections 131 are formed.

The pipe connector 170 is configured to interconnect the first supply pipe 150 and the second supply pipe 160 that extend in different directions. The pipe connector can redirect water flow. The pipe connector 170 may be made of hard synthetic resin that is harder than the guide cap 130, which can advantageously and significantly suppress movement of the first supply pipe 150 and the second supply pipe 160 as compared with the related art. Stoppers 171 may be formed on the inner surface of the pipe connector 170 and act to prevent the first supply pipe 150 and the second supply pipe 160 from moving further inside the pipe connector 170. One end portion of the pipe connector 170 may be fitted to the guide cap 130.

Figure 5:
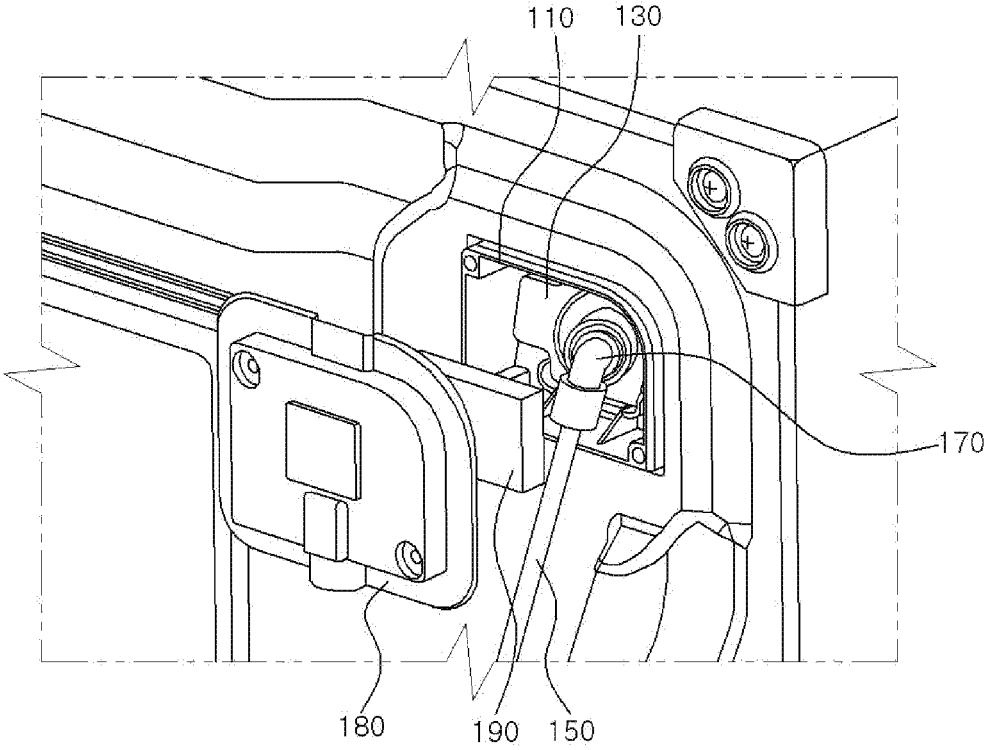
FIG. 5 is a perspective view illustrating the configuration of an exemplary cover part installed in the water supply unit according to one embodiment of the present disclosure.

As illustrated in FIG. 5, the water supply unit 100 may further include a cover part 180 and an elastic member 190.

The cover part 180 may be coupled to the housing 110 and may cover and conceal the guide cap 130 and the pipe connector 170 so that they are not exposed to the outside. Therefore, the outward appearance of the guide cap 130 and the pipe connector 170 mounted inside the housing 110 can be advantageously improved, and dust or other extraneous material can advantageously be blocked from entering the housing 110. The cover part 180 may be fastened to the housing 110 by a fastening member such as a screw or a bolt.

The elastic member 190 may be disposed between the cover part 180 and the pipe connector 170 and fills an empty internal space. The elastic member 180 may press the pipe connector 170 to prevent it from being removed from the guide cap 130. The elastic member 190 may be made of Styrofoam for instance. The elastic member 190 made of Styrofoam can advantageously prevent heat transfer and thereby enhance thermal insulation.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only exemplary in all respects. The scope of the present disclosure is expressed by claims below, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator comprising:

an ice maker configured to convert water into ice for dispensing; and a water supply unit coupled to the ice maker and configured to supply water to the ice maker, wherein the water supply unit comprises:

a housing;

an ice maker tube inserted into the housing and coupled to the ice maker;

a guide cap comprising sealing projections inserted into the ice maker tube, wherein each of the sealing projections is spaced apart from neighboring sealing projections along a longitudinal direction of the ice maker tube, and wherein the sealing projections are configured to contact the ice maker tube and are operable to restrict water leakage from the ice maker tube; and a sealing washer configured to prevent ambient air from entering the ice maker tube, wherein the sealing washer is installed on an outer circumferential surface of one end portion of the ice maker tube, the outer circumferential surface facing the housing, wherein the sealing washer contacts the guide cap, wherein the ice maker tube comprises a first tube portion and a second tube portion, wherein the first tube portion has a larger diameter than that of the second tube portion, wherein the first tube portion is disposed in the one end of the ice maker tube to have a contact with the sealing washer, and wherein the first tube portion is configured to prevent the sealing washer and the ice maker tube from separating from each other.

2. The refrigerator of claim 1 further comprising:

a main body having a front opening to be opened when a door opens;

a refrigeration compartment disposed in a portion of the main body;

a freezer disposed in another portion of the main body; and a machine compartment disposed in a lower rear portion of the main body and comprising a valve configured to control water supply.

3. The refrigerator of claim 1, further comprising a heater installed on an outer circumferential surface of the ice maker tube and extending along the ice maker tube, the outer circumferential surface facing the housing, wherein the heater is operable to prevent ice formation.

4. The refrigerator of claim 3, further comprising an insulation member disposed between the heater and the housing.

5. The refrigerator of claim 2, wherein the water supply unit further comprises:

a first supply pipe configured to receive water from the valve;

a second supply pipe extending in a different orientation than the first supply pipe and inserted into the guide cap, wherein the second supply pipe is operable to supply water to the ice maker tube; and a pipe connector configured to interconnect the first supply pipe and the second supply pipe and configured to change a water flow direction, wherein the pipe connector is fitted to the guide cap.

* * * * *